US008694257B2

(12) United States Patent
Zamanian et al.

(10) Patent No.: US 8,694,257 B2
(45) Date of Patent: Apr. 8, 2014

(54) METHOD FOR DETERMINING UNCERTAINTY WITH PROJECTED WELLBORE POSITION AND ATTITUDE

(75) Inventors: S. Ahmad Zamanian, Cambridge, MA (US); Dimitrios Pirovolou, Rio de Janeiro (BR)

(73) Assignee: Schlumberger Technology Corporation, Sugar Land, TX (US)

( * ) Notice: Subject to any disclaimer, the term of this patent is extended or adjusted under 35 U.S.C. 154(b) by 529 days.

(21) Appl. No.: 12/871,197

(22) Filed: Aug. 30, 2010

(65) Prior Publication Data

US 2012/0048618 A1 Mar. 1, 2012

(51) Int. Cl.
*G01V 1/40* (2006.01)

(52) U.S. Cl.
USPC ..... 702/6

(58) Field of Classification Search
USPC ..... 702/6
See application file for complete search history.

(56) References Cited

U.S. PATENT DOCUMENTS

| | | | | |
|---|---|---|---|---|
| 5,113,953 | A | 5/1992 | Noble | |
| 5,265,682 | A | 11/1993 | Russell et al. | |
| 5,517,464 | A | 5/1996 | Lerner et al. | |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,603,385 | A | 2/1997 | Colebrook | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,778,992 | A | 7/1998 | Fuller | |
| 5,791,085 | A | 8/1998 | Szmidt et al. | |
| 5,803,185 | A | 9/1998 | Barr et al. | |
| 6,089,332 | A | 7/2000 | Barr et al. | |
| 6,092,666 | A | 7/2000 | Clark et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 6,401,842 | B2 | 6/2002 | Webb et al. | |
| 6,641,434 | B2 | 11/2003 | Boyle et al. | |
| 6,866,306 | B2 | 3/2005 | Boyle et al. | |
| 7,413,021 | B2 | 8/2008 | Madhavan et al. | |
| 2005/0209912 | A1 * | 9/2005 | Veeningen et al. | 705/11 |
| 2007/0057811 | A1 * | 3/2007 | Mehta | 340/853.3 |
| 2009/0000823 | A1 * | 1/2009 | Pirovolou | 175/61 |
| 2009/0166087 | A1 | 7/2009 | Braden et al. | |

* cited by examiner

*Primary Examiner* — Aditya Bhat
(74) *Attorney, Agent, or Firm* — Chadwick A. Sullivan; Brigitte Echols

(57) ABSTRACT

A system and method for determining uncertainty of a wellbore orientation is disclosed. The system and method obtains a measurement related to a first orientation of a drill string at a measurement device. Based on the first orientation and drilling settings, the system and method predict a second orientation. A probability of the second orientation being within a predetermined area is also obtained. As a result of this information, an action may be taken, such as, skipping a planned static survey, obtaining a static survey prior to the plan, or changing a drilling setting.

24 Claims, 6 Drawing Sheets

METHOD FOR DETERMINING UNCERTAINTY WITH PROJECTED WELLBORE POSITION AND ATTITUDE

BACKGROUND OF INVENTION

The present disclosure generally relates to a system and a method for determining uncertainty with a predicted wellbore position. More specifically, the system and method may determine a probability of an anticipated wellbore position being within a predetermined area.

To obtain hydrocarbons, a drill bit is driven into the ground surface to create a wellbore through which the hydrocarbons are extracted. Typically, a drill string is suspended within the wellbore, and the drill bit is located at a lower end of sections of drill pipe which form the drill string. The drill string extends from the surface to the drill bit. The drill string has a bottom hole assembly ("BHA") located proximate to the drill bit.

Directional drilling is the steering of the drill bit so that the drill string travels in a desired direction. Before drilling begins, a well plan is established which indicates a target location and a drilling path to the target location. After drilling commences, the drill string is directed from a vertical drilling path in any number of directions to follow the well plan. Directional drilling may direct the wellbore toward the target location.

Further, directional drilling may form deviated branch wellbores from a primary wellbore. For example, directional drilling is useful in a marine environment where a single offshore production platform may reach several hydrocarbon reservoirs by utilizing deviated wells that may extend in any direction from the drilling platform. In addition, directional drilling may control the direction of the wellbore to avoid obstacles, such as, for example, formations with adverse drilling properties. Directional drilling may also enable horizontal drilling through a reservoir.

Moreover, directional drilling may correct deviation from the drilling path established by the well plan. Typically, the trajectory of the drill bit deviates from the trajectory established by the well plan due to unpredicted characteristics of the formations being penetrated and/or the varying forces experienced at the drill bit and the drill string. Upon detection of such deviations, directional drilling may return the drill bit back to the drilling path established by the well plan.

Known methods of directional drilling use a mud motor system or a rotary steerable system ("RSS"). For a RSS, the drill string is rotated from the surface, and downhole devices cause the drill bit to drill in the desired direction. A RSS is typically more expensive to operate than a mud motor system. For a mud motor system, the drill pipe is held rotationally stationary during a portion of the drilling operation while the mud motor rotates the drill bit. The toolface of the BHA is an angular measurement of the orientation of the BHA relative to the top of the wellbore, known as gravity tool face, or relative to magnetic north, known as magnetic tool face. For a mud motor system, rotating the drill string changes the orientation of the toolface of the bent segment in the BHA. To effectively steer the drill bit, the operator or the automated system controlling the directional drilling must determine the current location and position of the drill bit and the toolface orientation.

Data measured at the surface and/or measured downhole is used to determine the current location and position of the drill bit and the toolface orientation. For example, the current location and position of the BHA are determined using measurements of the inclination and the azimuth of the BHA, known as "D&I" measurements. A measurement-while-drilling (MWD) tool located in the upper end of the BHA obtains the D&I measurements. The MWD tool may have an accelerometer and a magnetometer to measure the inclination and azimuth, respectively. The toolface orientation is determined using a toolface sensor that may be connected to the mud motor or rotary steerable system. The toolface sensor may use an accelerometer, a gyroscope or other measuring device to determine an angle of the toolface. The toolface sensor is typically closer to the drill bit than the MWD tool.

The D&I measurements are obtained by static surveys made at various time or depth intervals. The operator or the automated system uses the estimated location and the estimated position to control the directional drilling. However, D&I measurements are typically obtained at a distance from the drill bit, such as, for example, tens of feet. The D&I measurements at this distance from the BHA may not be indicative of the actual D&I at the drill bit, and, accordingly, the estimated location and/or the estimated position of the drill bit may be inaccurate. The directional drilling may be compromised because of the inaccurate estimated location of the drill bit.

In addition, moving the drill bit to the drilling path established by the well plan may be difficult after deviation from the drilling path. Accordingly, accurately determining how to direct the drill bit to the course established by the well plan may make directional drilling more consistent and predictable relative to currently known systems.

DETAILED DESCRIPTION

Figure 1:
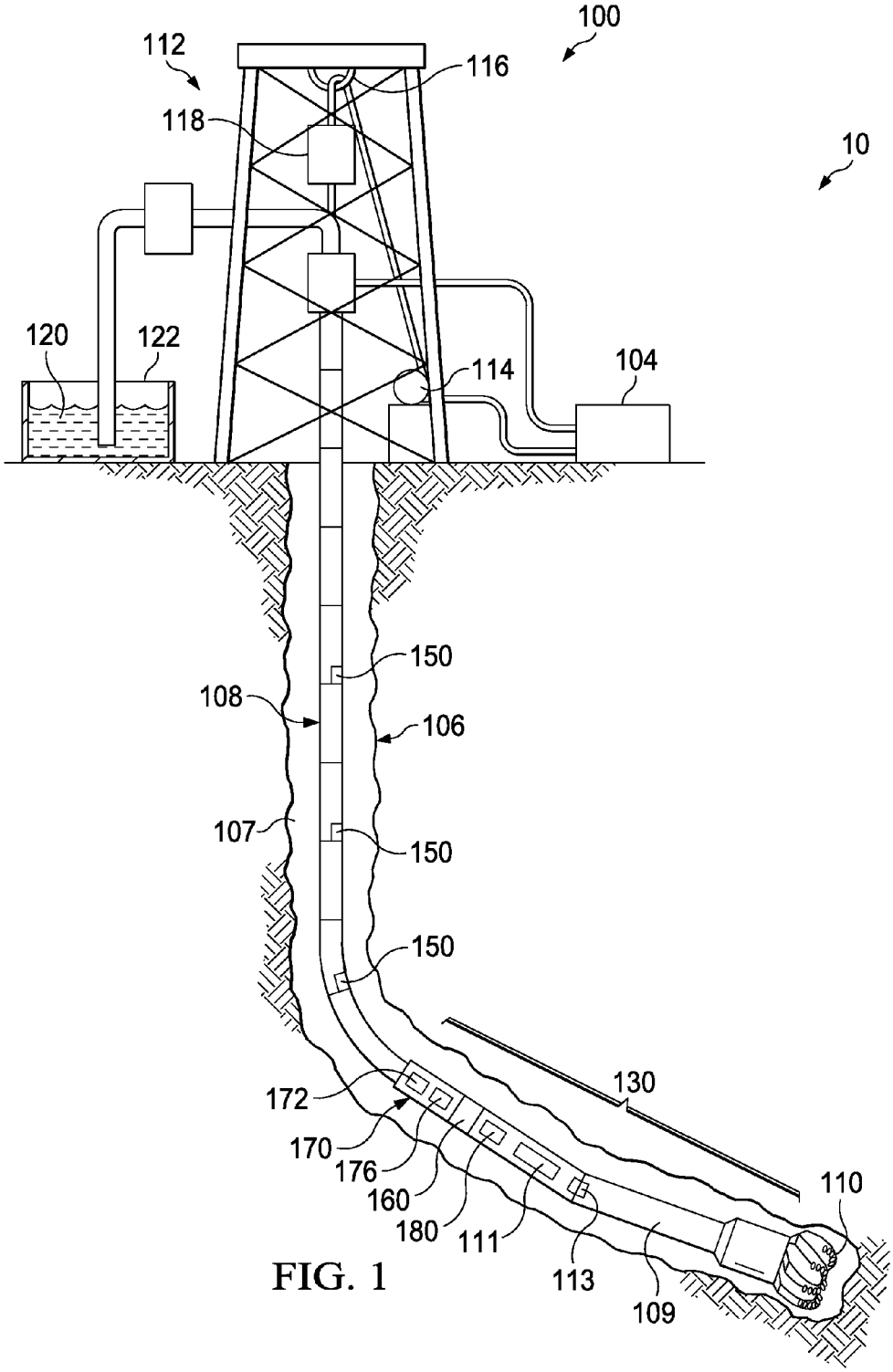
FIG. 1 illustrates a system having a drill string and an orientation measuring device in an embodiment of the present invention.

The present disclosure generally relates to a system and a method for predicting an orientation of a drill string. More specifically, the present disclosure relates to a system and a method which may estimate a position and an orientation of the drill bit during directional drilling and may determine an uncertainty or probability related to the prediction.

It should be appreciated by those having ordinary skill in the art that while the present disclosure identifies methods of applying the invention to directional drilling, the teachings of the disclosure may be applied to many other areas within wellbore design and control. In addition, the present disclosure has applications outside of the oilfield and may be used in any field where predicting orientation of a moving object is beneficial, such as in the aerospace or nautical fields.

Referring now to the drawings wherein like numerals refer to like parts, FIG. 1 generally illustrates a directional drilling system 10 (hereinafter "the system 10"). A drilling operation may be conducted at a wellsite 100 using the directional drilling system. The wellsite 100 may have a wellbore 106 formed by drilling and/or penetrating one or more subsurface formations.

The system 10 may have a terminal 104. The terminal 104 may be any device capable of receiving and/or processing data, for example, a desktop computer, a laptop computer, a mobile cellular telephone, a personal digital assistant ("PDA"), a 4G mobile device, a 3G mobile device, a 2.5G mobile device, a satellite radio receiver and/or the like. The terminal 104 preferably has a database for storing at least a portion of data received by the terminal 104. The terminal 104 may be located at the surface and/or may be remote relative to the wellsite 100. In an embodiment, the terminal 104 may be located in the wellbore 106. The present disclosure is not limited to a specific embodiment or a specific location of the terminal 104, and the terminal 104 may be any device that may be used in the system 10. Any number of terminals may be used to implement the system 10, and the present disclosure is not limited to a specific number of terminals.

The system 10 may have a drill string 108 suspended within the wellbore 106, and a drill bit 110 may be located at the lower end of the drill string 108. The drill string 108 and the walls of the wellbore 106 may form an annulus 107. The system 10 may have a land-based platform and derrick assembly 112 positioned over the wellbore 106. Alternatively, the platform may be an offshore drilling ship, offshore drilling rig or other offshore derrick assembly 112. The assembly 112 may have a hook 116, and/or a top drive 118 may be suspended from the hook 116. The top drive 118 may have one or more motors (not shown) and/or may rotate the drill string 108. The assembly 112 may have drawworks 114 to raise, suspend and/or lower the drill string 108. During drilling, the drawworks 114 may be operated to apply a selected axial force as weight-on-bit ("WOB") to the drill bit 110 as a result of the weight of the drill string 108. More specifically, a portion of the weight of the drill string 108 is suspended by the drawworks 114, and an unsuspended portion of the weight of drill string 108 is transferred to the drill bit 110 as the WOB. The drawworks 114 may have an encoder (not shown in the drawings) which may be configured to determine the depths of points along the drill string 108. The terminal 104 may be communicatively connected to the encoder to generate a log of depth of the drill bit 110 as a function of time.

It should also be appreciated by those having ordinary skill in the art that the drill string 108 may comprise a single-shouldered drill string, a double-shouldered drill string, a wired drill string, coiled tubing, casing or combinations thereof. For example, the drill string 108 may comprise coiled tubing, and a cable for communications may extend within the coiled tubing for communication and power to components at an end of the coiled tubing.

Drilling fluid 120 may be stored in a reservoir 122 formed at the wellsite 100. A pump 134 may deliver the drilling fluid 120 to the interior of the drill string 108 to induce the drilling fluid 120 to flow downward through the drill string 108. A mud motor 111 may use the flow of the drilling fluid 120 to generate electrical power. The drilling fluid 120 may exit the drill string 108 through ports (not shown) in the drill bit 110 and then may circulate upward through the annulus 107. Thus, the drilling fluid 120 may lubricate the drill bit 110 and may carry formation cuttings up to the surface as the drilling fluid 120 returns to the reservoir 122 for recirculation.

Sensors 150 at various positions along the drill string 108 may obtain data, preferably in real-time, concerning the operation and the conditions of the drill string 108, the drilling fluid, and/or the formation about the wellbore annulus 107. For example, the sensors 150 may obtain information related to a flow rate of the drilling fluid, a temperature of the drilling fluid, a composition of the drilling fluid, a stress or strain on the drill string 108, and/or a rotational speed of the drill string 108. Other measurements or data that may be obtained by the sensors 150 may be related to wellbore pressure, weight-on-bit, torque-on-bit, direction, inclination, collar rpm, tool temperature, annular temperature, toolface, and/or any other measurement that may be beneficial to those having ordinary skill in the art.

In addition, the sensors 150 may be positioned at the wellsite at or near the wellsite assembly 112. The sensors 150 may provide information about surface conditions, such as, for example, standpipe pressure, hookload, depth, surface torque, rotary rpm and/or the like. The information obtained by the sensors 150 may be transmitted to various components of the system 10, such as, for example, the terminal 104.

The drill string 108 may have a BHA 130 proximate to the drill bit 110. The BHA 130 may have one or more tools, devices or sensors for measuring a property of the wellbore 106, the formation about the wellbore 106, and/or the drill string 108. For example, the BHA 130 may have a logging-while-drilling (LWD) module 160. The LWD module 160 may be housed in a drill collar of the BHA 130 and may have one or more known types of logging tools. The LWD module 160 may have capabilities for measuring and processing data acquired from and/or through the wellbore 106.

The BHA 130 may have a toolface sensor 180 which determines the toolface orientation of the BHA 130. The toolface sensor 180 may use one or more magnetometers and/or accelerometers to determine the azimuthal orientation of the BHA 130 relative to the earth's magnetic north and/or may use one or more gravitation sensors to determine the azimuthal orientation of the BHA 130 relative to the earth's gravity vector. The toolface sensor 180 may use any means for determining the toolface orientation of the BHA 130 known to one having ordinary skill in the art.

The BHA 130 may have a measuring-while-drilling (MWD) module 170. The MWD module 170 may be housed in a drill collar located at the upper end of the BHA 130 and may have one or more devices for measuring characteristics of the drill string 108 and the drill bit 110. For example, the MWD module 170 may measure physical properties, such as, for example, pressure, temperature and/or wellbore trajectory. The MWD module 170 may have a D&I sensor 172 which may determine the inclination and the azimuth of the BHA 130. For example, the D&I sensor 172 may use an accelerometer and/or a magnetometer to determine the inclination and the azimuth of the BHA 130. The D&I sensor 172 may use any means for determining the inclination and the azimuth of the BHA 130 known to one having ordinary skill in the art.

The MWD module 170 may have a mud flow telemetry device 176 which may selectively block passage of the drilling fluid 20 through the drill string 108. The mud flow telemetry device 176 may transmit data from the BHA 130 to the surface by modulation of the pressure in the drilling fluid 20. Modulated changes in pressure may be detected by a pressure sensor 180 communicatively connected to the terminal 104. The terminal 104 may interpret the modulated changes in pressure to reconstruct the data sent from the BHA 130. For example, the mud flow telemetry device 176 may transmit the inclination, the azimuth and the toolface orientation to the surface by modulation of the pressure in the drilling fluid 20, and the terminal 104 may interpret the modulated changes in pressure to obtain the inclination, the azimuth and the toolface orientation of the BHA 130. The mud pulse telemetry may be implemented using the system described in U.S. Pat. No. 5,517,464 assigned to the assignee of the present disclosure and incorporated by reference in its entirety. Alternatively, wired drill pipe, electromagnetic telemetry and/or acoustic telemetry may be used instead of or in addition to mud pulse telemetry. For example, mud pulse telemetry may be used in conjunction with or as backup for wired drill pipe as described hereafter.

Wired drill pipe telemetry may communicate signals along electrical conductors in the wired drill pipe. Wired drill pipe joints may be interconnected to form the drill string 108. The wired drill pipe may provide a signal communication conduit communicatively coupled at each end of each of the wired drill pipe joints. For example, the wired drill pipe preferably has an electrical and/or optical conductor extending at least partially within the drill pipe with inductive couplers positioned at the ends of each of the wired drill pipe joints. The wired drill pipe may enable communication of the data from the BHA 130 to the terminal 104. Examples of wired drill pipe that may be used in the present disclosure are described in detail in U.S. Pat. Nos. 6,641,434 and 6,866,306 to Boyle et al. U.S. Pat. No. 7,413,021 to Madhavan et al. and U.S. Pat. No. 7,806,191 to Braden et al., assigned to the assignee of the present application and incorporated by reference in their entireties. The present disclosure is not limited to a specific embodiment of the telemetry system. The telemetry system may be any system capable of transmitting the data from the BHA 130 to the terminal 104 as known to one having ordinary skill in the art.

At an end of the drill string 108, the drill bit 110 may be attached or secured. The drill bit 110 may be connected to a bent sub 109 which may be angled relative to the BHA 130. In an embodiment, the bent sub 109 may be angled approximately two degrees or less relative to the BHA 130. The mud motor 111 may be connected to the bent sub 109 and/or may rotate the bent sub 109 and/or the drill bit 110 without rotation of the drill string 108. The mud motor 111 and/or the bent sub 109 may be connected to a mechanical transmission 113. The mechanical transmission 113 may prevent rotation of the bent sub 109 relative to the remainder of the drill string 108 if the drill string 108 is rotating. The mechanical transmission 113 may enable the mud motor 111 to rotate the bent sub 109 if the drill string 108 is sliding.

Another known method of directional drilling includes the use of an RSS (not shown) with one or more of the various components shown in FIG. 1. In the RSS, downhole devices cause the drill bit 110 to drill in a desired or predetermined direction. The RSS may be used to drill deviated wellbores into the earth. Example types of the include a "point-the-bit" system and a "push-the-bit" system. In the point-the-bit system, the axis of rotation of the drill bit 110 is deviated from the local axis of the BHA 130 in the general direction of the new hole. The wellbore 106 may be propagated in accordance with the customary three point geometry defined by upper and lower stabilizer touch points and the drill bit 110. The angle of deviation of the axis of the drill bit 110 may be coupled with a finite distance between the drill bit 110 and lower stabilizer and may result in the non-collinear condition required for a curve to be generated. There are many ways in which this may be achieved including a fixed bend at a point in the BHA 130 adjacent to the lower stabilizer or a flexure of the drill bit drive shaft distributed between the upper and lower stabilizer. Examples of point-the-bit type rotary steerable systems, and how they operate are described in U.S. Pat. Nos. 6,401,842; 6,394,193; 6,364,034; 6,244,361; 6,158,529; 6,092,666; and 5,113,953 all herein incorporated by reference.

In the push-the-bit rotary steerable system, there is usually no specially identified mechanism to deviate the axis of the drill bit 110 from the local bottomhole assembly axis; instead, the requisite non-collinear condition may be achieved by causing either or both of the upper or lower stabilizers to apply an eccentric force or displacement in a direction that is preferentially orientated with respect to the direction of hole propagation. Again, there are many ways in which this may be achieved, including but not limited to non-rotating (with respect to the hole) eccentric stabilizers (displacement based approaches) and eccentric actuators that apply force to the drill bit in the desired steering direction. Again, steering is achieved by creating non co-linearity between the drill bit 110 and at least two other touch points. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

The wellbore 106 may be drilled according to a well plan established prior to drilling. The well plan typically sets forth equipment, pressures, trajectories and/or other parameters that define the drilling process for the wellsite 100. The well plan may establish a target location, such as, for example, a location within or adjacent to a reservoir of hydrocarbons, and/or may establish a drilling path by which the drill bit 110 may travel to the target location. The drilling operation may be performed according to the well plan. However, as the information is obtained, the drilling operation may need to deviate from the well plan. For example, as drilling or other operations are performed, the subsurface conditions may change, and the drilling operation may require adjustment.

A measurement device, such as the MWD module 170 and/or the D&I sensor 172, in the drill string 108 may obtain a measurement related to an orientation and/or position of the drill string 108. The orientation and/or position of the drill string 108 may be a position of the drill string 108 at a device obtaining the positional measurement, such as the D&I sensor 172. To obtain an accurate orientation and position of the drill string 108 at the location of the measuring device, a static survey or other static measurement is typically required. The static measurement permits the D&I sensor 172 or other measurement device to obtain a positional measurement along three-axes with respect to the drill string 108, such as an x, y, and z axis related to the position of the drill string 108.

As drilling progresses, it is beneficial to predict the position of the drill string 108 and/or the drill bit 110 at a future or anticipated position based on drilling settings. However, an actual position of the drill string 108 beyond the device obtaining the positional measurement and even an actual position at the drill bit 110 is generally unknown. Advantageously, projecting from the last positional measurement, such as projecting from the position and attitude of the Direction & Inclination (D&I) sensor 172 at the last static survey, to the hole depth where the drill bit 110 is currently located, an estimated attitude and position for the drill bit 110 may be obtained. In some situations, it may be advantageous to project even further to an expected hole depth of the next static survey, in order to estimate or predict where the drill string 108 and/or the drill bit 110 may be positioned at the next planned survey point. The next planned survey point may, for example, be predetermined based on depth or distance from the last static survey. As another example, the next planned survey point may be taken for other reasons, such as pause or a stoppage in drilling. Positional projections may be performed by using any variety of methods, from a simple spreadsheet calculation to a more sophisticated method using a processor and/or software that may involve the calibration of a model of Bottom Hole Assembly (BHA) steering behavior.

In addition, the present system and method may not only predict a position of the drill string 108 and/or the drill bit 110 at a future position but also determine an uncertainty or probability of error associated with the predicted position. In order to do so, an algorithm may be used to determine the uncertainty and/or the probability of error. The projection uncertainty algorithm accounts for the errors associated with the projections and outputs an areas area within which the actual positional measurement is expected to fall (in both attitude and position), along with the associated probabilities of the actual positional measurement being within the area. The area may be sized and shaped based on the uncertainty of the predicted position. In an embodiment, the area may be an elliptical area.

It should be understood that the predicted position may be a predicted actual position or a predicted survey measurement. While in some instances the predicted actual position and the predicted survey measurement may be substantially similar, in most instances each positional measurement will have a given error associated compared to the actual position.

The uncertainty projection algorithm may utilize historical static and continuous survey measurements, which generally only permit measurements along two axes, to compute the running errors between the predicted positional measurement and the obtained positional measurement. The errors over a moving window of previous measurements are combined to estimate probability distributions for the curvature errors in the projection. These distributions are used to produce probabilistic areas of projection uncertainty, in inclination and azimuth, with their associated probabilities. These areas of uncertainty in inclination and azimuth are mapped to areas of uncertainty in position (with associated probabilities) using an interpolation technique, such as minimum curvature.

An example will now be described to better illustrate the present invention. The present invention should not be deemed as limited to this example, but instead appreciate that this example is used to illustrate how the present invention may be utilized. Assume a well is drilled with a particular set of downlinked tool settings d[s], resulting in the actual well orientation described by inclination I(s) and azimuth A(s). Inclination and azimuth are measured at regular intervals using static survey measurements $i_s[s]$ and $a_s[s]$ and continuous survey measurements $i_c[s]$ and $a_c[s]$. (Here s is the independent variable representing hole depth.) A model may be used, such as a four-parameter model (with parameter set k), which characterizes the depth derivatives of inclination and azimuth (the build and turn curvature) in terms of the model parameters and tool settings. In particular, $$\hat{BC} = \frac{dI}{ds} = f_1(k, d[s])$$

$$\hat{TC} = \sin I(s)\frac{dA}{ds} = f_2(k, d[s])$$

The model may be calibrated by a processor and/or software by any technique or method as known to those having ordinary skill in the art. One example is tuning the parameters k[s] at regular depth intervals to minimize the mean squared error between the modeled and measured build curvature (hereinafter "BC") and turn curvature (hereinafter "TC") over a given depth window, such as a predetermined distance, for example, 300 feet.

The calibrated model and/or the drilling settings may be used to (1) project ahead from the last static survey measurement at the D&I sensor 172 to the drill bit 110 and to (2) invert the model to map the desired control action at the drill bit 110, such as the desired BC and TC, to recommended settings. The recommended settings may be, for example, a toolface setting, a steering ratio or power setting, a BC, a TC, rotations per minute ("RPM"), weight-on-bit or other setting relating to positioning the drill string 108 and/or the drill bit 110. As such, the accuracy of the model is a strong indicator of the quality of the recommended settings that may be generated by the software, processor and/or algorithm in order to steer or direct the drill string 108 and/or the drill bit 110 in a desired direction, such as along a well plan. The projections are computed by integrating the model BC and TC equations over intervals of constant tool settings from the depth of the D&I sensor 172 to the depth of the drill bit 110 to obtain the inclination and azimuth at the drill bit 110.

It is proposed that the accuracy of the calibrated model is quantified by comparing projected hole orientations (using the calibrated model parameters k[s]) to actual measurements (both continuous and static survey measurements). The errors are combined over a depth window of previous estimates and measurements in order to ensure confidence in the error calculations. The historical errors may be then used in a mathematically consistent formulation to propagate the positional uncertainty associated with predicted positional measurement. The positional uncertainty can be used both as an indicator of when to downlink (when compared with a desired allowable deviation from plan, ADP, propagating forward using the current tool settings) as well as an indication of the reliability of the recommended settings that arise from using the model and calibrated model parameters.

The computations for the errors are iterated over every successive static survey measurement to give the historical data for the errors in the turn curvature and build curvature. Assuming the deviations in BHA behavior from the calibrated model can be approximated by a normal distribution, the historical data for the error in the build curvature and turn curvature may be used to propagate the positional uncertainty in the predictions. In particular, one assumption may be that the BC errors and TC errors both arise from uncorrelated normal distributions and make the assumption that (since the parameters were estimated to minimize the error in these values) the means of these distributions are where the errors are zero.

Assuming a normal distribution, such as a bivariate normal distribution, for the BC and TC errors allows for an estimate of the probability of the projected inclination and azimuth being within a specified range from the true inclination and azimuth (or measured inclination and azimuth at the projection depth). In particular, let there be a predetermined area, such as a skewed, deformed ellipse in the inclination-azimuth plane, whose center point is the projected inclination and azimuth from the current static survey $s_n$ to the next expected static survey resulting from the calibrated model parameters at the current static survey $k[s_n]$. Since the errors are assumed to arise from normal distributions with the above variances, the probability of the actual inclination and azimuth at the predicted positional measurement falling within this predetermined area may be determined, by computing the error in projected inclination and azimuth caused by an error in BC and TC. As the probability distribution for the errors in BC and TC has been computed, the probability of the BC and TC errors, and hence probability of the errors in projected inclination and azimuth taking specific values can be computed.

In other words, for a given predetermined area, a probability that the actual inclination and azimuth will lie within the predetermined area may be determined. For example, in an embodiment where the predetermined area is an ellipse, the ellipse of uncertainty in inclination and azimuth can be mapped to an ellipse of uncertainty in position by use of an interpolation method, such as the minimum curvature method. The minimum curvature algorithm, for example, may use the initial position, initial orientation, arc length, and final orientation as inputs, and return the final position as the output, assuming a relationship between the positions, whether linear, polymeric or a spherical arc between the initial and final points. The result of performing the minimum curvature method on a set of final inclinations and azimuths defined by the above ellipse will result in an elliptical section of a curved surface. This surface, propagated forward at successive arc lengths, can form into a travelling ellipse of uncertainty for the true position of the next survey.

This data can then be used to find the ratio of survey measurements falling within a series of predetermined areas, where each area is larger than the preceding one. The larger the predetermined area of uncertainty, the confidence increases that the predicted measurement position will lie within the predetermined area. The ratio of future measurements falling within a group or family of ellipses sharing the same probability should be equal to the probability associated with that family of ellipses. If the ratio of future measurements falling within a specific family of ellipses is greater than its associated probability, then the ellipses are too large and over-estimate the level of uncertainty, whereas if the ratio is less than this associated probability then the ellipses are too small and under-estimate the level of uncertainty.

Figure 2A:
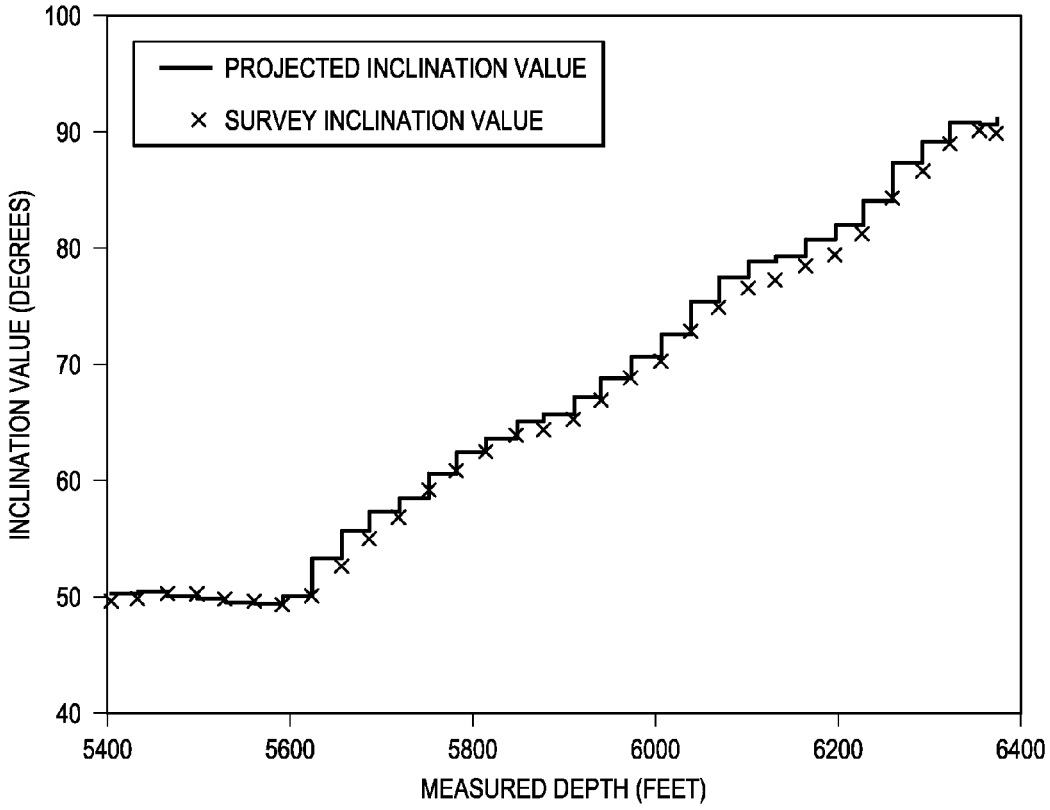
FIG. 2A illustrates an example of a projected inclination value and an actual inclination value that may be obtained in an embodiment of the present invention.
Figure 2B:
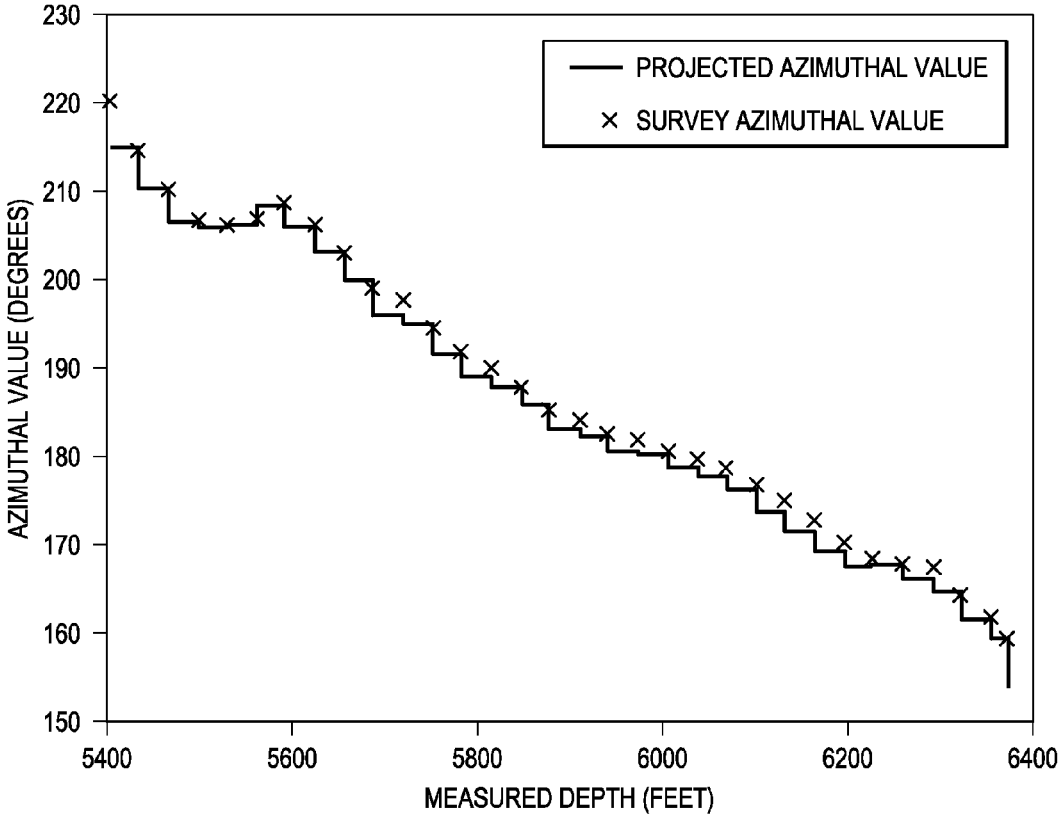
FIG. 2B illustrates an example of a projected azimuthal value and an actual azimuthal value that may be obtained in an embodiment of the present invention.

The inclination and azimuth from last static survey may be projected to one or more continuous survey depths and to the next static survey before the next static survey using the method described herein. There may be any number of continuous surveys obtained between static surveys. FIG. 2A illustrates data of a series of predicted inclinations and the actual inclination measured that may be obtained using the system and method of the invention. FIG. 2B illustrates an example of a projected azimuthal value and an actual azimuthal value that may be obtained in an embodiment of the present invention.

Figure 2C:
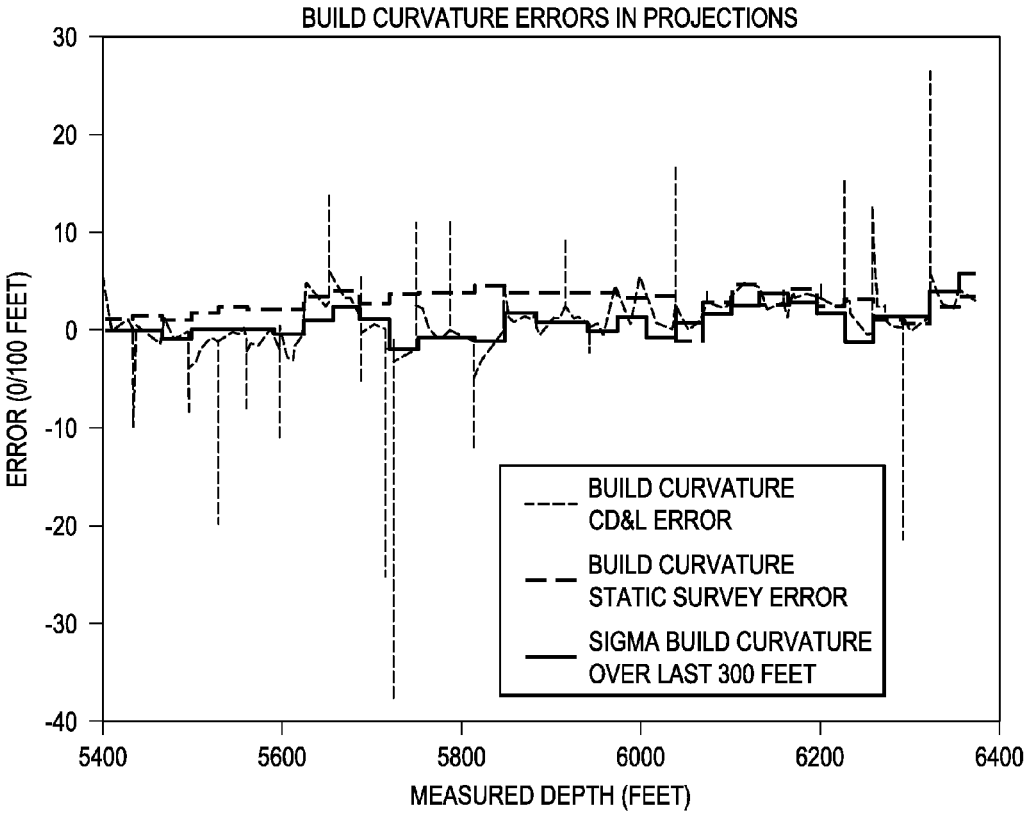
FIG. 2C illustrates build curvature ("BC") values and errors in those values in an embodiment of the present invention.
Figure 2D:
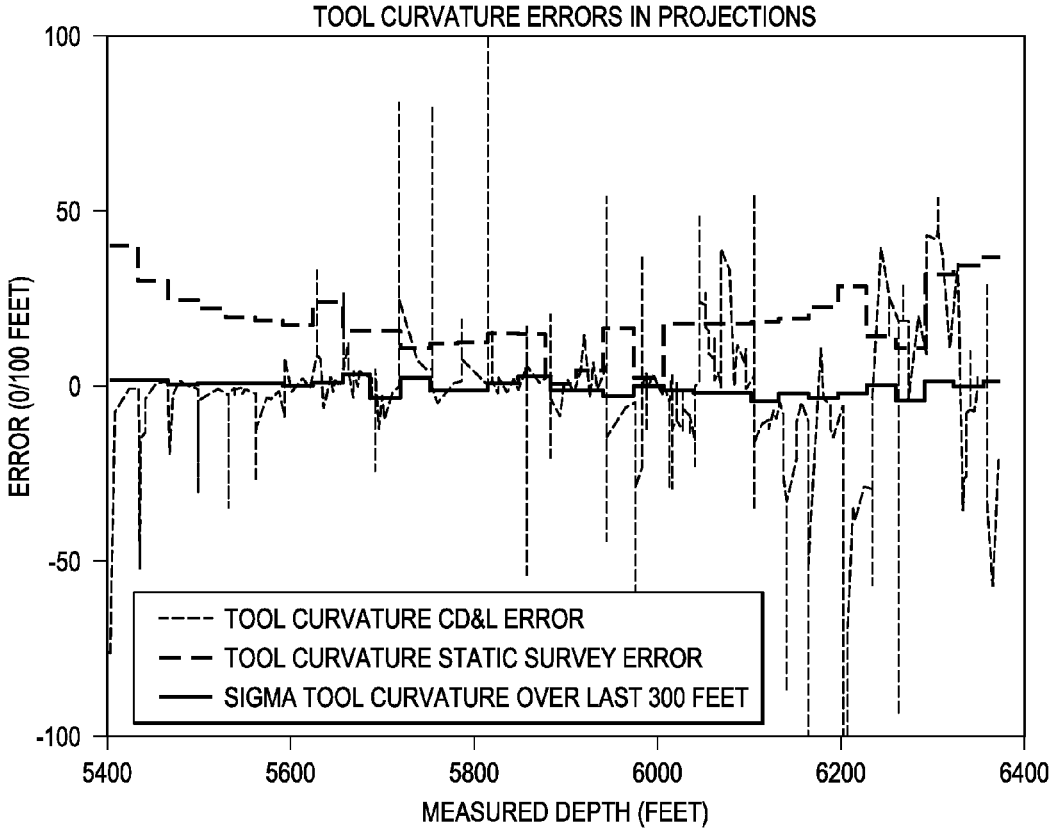
FIG. 2D illustrates tool curvature values and errors in those values in an embodiment of the present invention.

Next, error between the projected inclination and azimuth and the actual inclination and azimuth at continuous and static surveys in build curvature (inclination error) and turn curvature (azimuth error multiplied by sine inclination) components may be computed. FIG. 2C illustrates build curvature ("BC") values and errors in those values may be obtained in an embodiment of the present invention. FIG. 2D illustrates tool curvature values and errors in those values may be obtained in an embodiment of the present invention.

Figure 3:
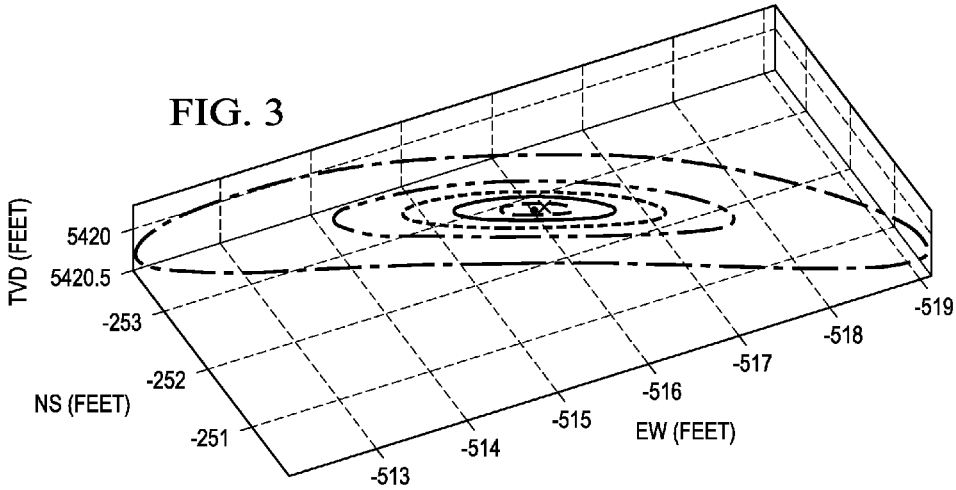
FIG. 3 illustrates a projected positional measurement and a series of predetermined areas where each predetermined area represents a probability that the projected positional measurement will lie within that predetermined area in an embodiment of the present invention.
Figure 4:
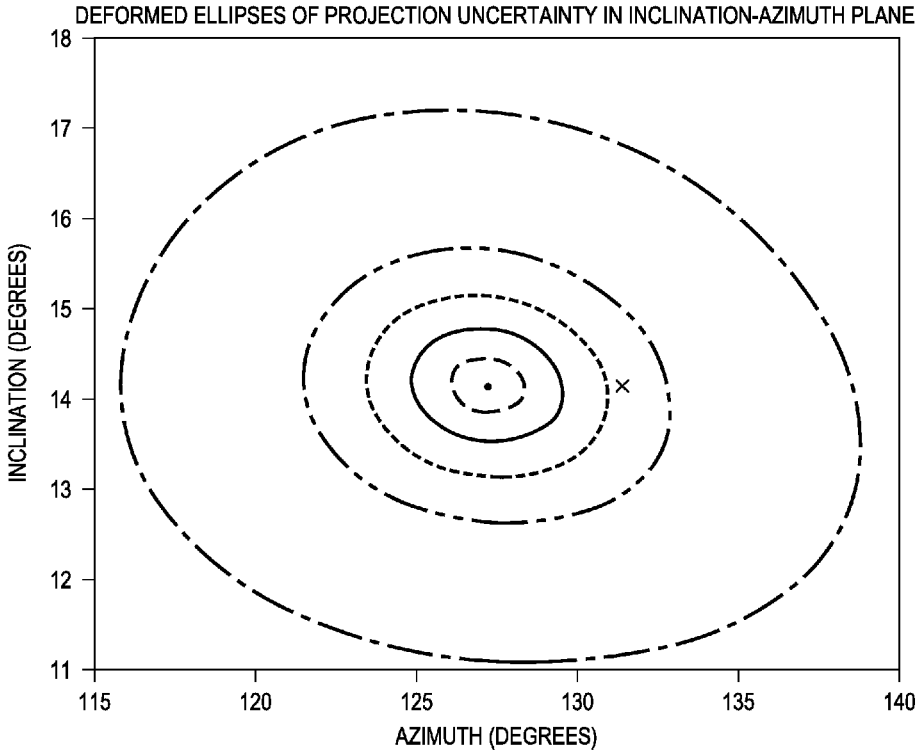
FIG. 4 illustrates a plurality of areas of uncertainty about a projected positional measurement in inclination and azimuth in an embodiment of the present invention.

Assuming the mean-error is zero, take the population variance of these errors over a moving window. Based on this, normal distribution of errors in the BC and TC axes may be obtained that evolve with measured depth. Then, a predetermined area of uncertainty may be created along with a probability that the predicted orientation will lie within the predetermined area. For example, ellipses of uncertainty pertaining to the probabilities that the measured inclination and azimuth will lie within a certain "elliptical radius" from the projected inclination and azimuth may be computed. The predetermined areas of uncertainty in inclination and azimuth may then be mapped to areas of uncertainty in position. FIG. 3 illustrates an embodiment of a projected positional measurement and a series of predetermined areas of uncertainty where each predetermined area represents a probability that the positional measurement at the projected hole depth will lie within that predetermined area. FIG. 4 illustrates the predetermined areas of uncertainty in inclination and azimuth in which the future measured inclination and azimuth is expected lie, where each successively larger predetermined area represents a larger probability that the measured inclination and azimuth at the projected hole depth will lie within that predetermined area.

Numerous benefits can be derived from a quantitative description of the level of uncertainty associated with the projections, including allowing the driller and/or surface processor to determine the level of confidence the drill string 108 and/or the drill bit 110 is following a predetermined well-plan, and indicating if it is necessary to take a static survey positional measurement and downlink new steering settings more frequently in order to follow the well-plan within a given envelope. In other words, obtaining another static survey prior to the projected positional measurement will likely increase the probability that the predicted positional measurement will lie within the predetermined area and/or decrease the predetermined area of uncertainty for a given probability. In addition, another benefit includes providing an indication of the reliability of recommended steering settings computed using the model upon which the projections are based, for example, by using the length of the $\pm 1\sigma$ (one sigma) confidence interval to indicate the level of model uncertainty. Third, it is beneficial to have an indication of when it is necessary to issue a new steering setting based on comparison of the position of the ellipse associated with a particular level of uncertainty (for example, at the $\pm 2\sigma$ (two sigma) confidence interval) relative to an acceptable deviation from the plan (ADP).

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

The following is claimed:

1. A method for determining a quantitative uncertainty of a wellbore orientation, comprising:

obtaining a measurement related to a first orientation of a drill string using a measurement device connected to the drill string; and operating a terminal communicatively connected with the measurement device to:

predict a second orientation of the drill string based on drilling settings and the first orientation; and determine a quantitative probability that the second orientation will be within a first predetermined area of uncertainty about the second orientation, wherein the determined quantitative probability is a percentage ranging between 0 and 1.

2. The method of claim 1 wherein the second orientation is at a position that the measurement device is projected to reach.

3. The method of claim 1 wherein the second orientation is at a position beyond a drill bit connected to the drill string.

4. The method of claim 1 wherein the measurement related to the first position includes an inclination and azimuth.

5. The method of claim 1 wherein the first predetermined area has an elliptical shape.

6. The method of claim 1 wherein the step of obtaining a measurement related to the first position includes performing a static survey of the wellbore position or orientation.

7. The method of claim 1 wherein the drilling settings include a tool face and a build curvature.

8. The method of claim 7 further comprising:

performing an action based on the uncertainty, the action selected from the group of: ceasing to drill the wellbore and performing a static survey of a wellbore orientation, modifying the tool face, modifying the build curvature, and skipping a planned static survey.

9. The method of 1 further comprising:

determining an uncertainty pertaining to the quantitative probability that the second orientation will be within a second predetermined region, the second predetermined region including all of the first predetermined region, wherein the determined uncertainty is a percentage ranging between 0 and 1.

10. The method of claim 1 further comprising:

comparing the predicted second orientation to a well plan;

determining whether the uncertainty associated with the predicted second orientation is acceptable; and performing an action based on the uncertainty and the comparison of the predicted second orientation to the well plan.

11. The method of claim 10 wherein a position at the second orientation is determined by obtaining a length of the drill string between the first orientation and the second orientation.

12. The method of claim 1 wherein the determined quantitative probability is greater than 0 and less than 1.

13. A method for determining a quantitative uncertainty of a wellbore orientation comprising:

predicting, using a terminal, a first orientation measurement at a first position of the drill string, wherein the first position is located at a position in which the drill string is expected to reach;

obtaining, using a measurement device connected to the drill string and communicatively connected with the terminal, the first orientation measurement at a position adjacent the first position;

determining, using the terminal, an error between the first orientation measurement predicted and the first orientation measurement obtained;

predicting, using the terminal, a second orientation measurement at a second position of the drill string, the second position being a position beyond the first position that the drill string is expected to reach; and determining, using the terminal, a quantitative uncertainty associated with the second positional measurement based on the error, wherein the determined quantitative uncertainty is a percentage ranging between 0 and 1.

14. The method of claim 13 wherein the first orientation measurement and the second orientation measurement comprise at least an azimuth and an inclination.

15. The method of claim 13 wherein the quantitative uncertainty is a quantitative probability that the predicted second orientation measurement is accurate, wherein the quantitative probability is a percentage ranging between 0 and 1.

16. The method of claim 13 wherein the quantitative uncertainty is a quantitative probability that the predicted second orientation measurement is within a predetermined range of positions about the predicted second orientation measurement, wherein the quantitative probability is a percentage ranging between 0 and 1.

17. The method of claim 13 wherein the step of determining the error includes computing a difference between the predicted second orientation measurement and the obtained second orientation measurement normalized by projection distance.

18. The method of claim 13 wherein the determined quantitative uncertainty is greater than 0 and less than 1.

19. A method for determining a quantitative uncertainty of a wellbore orientation comprising:

obtaining a first orientation measurement at a first position in the wellbore using a measurement device connected to a drill string within the wellbore;

calibrating a model to predict a second orientation measurement based on the first orientation, a build curvature and a turn curvature of the drill string, using a terminal communicatively connected with the measurement device, wherein the second position is a predicted position that the wellbore will reach;

at the first position, predicting a second orientation measurement at a second position using the terminal;

adjacent the second position, obtaining the second orientation using the measurement device;

computing an error between the predicted second orientation measurement and the obtained second orientation measurement using the terminal;

predicting a third orientation measurement at a third position based on the build curvature, the turn curvature and the second orientation measurement, using the terminal, wherein the third position is adjacent to or beyond a location of a drill bit attached to the drill string; and determining a quantitative uncertainty associated with the predicted third orientation measurement using the terminal, wherein the determined quantitative uncertainty is a percentage ranging between 0 and 1.

20. The method of claim 19 further comprising:

presenting the quantitative uncertainty of the third orientation measurement by defining a region about the predicted third orientation measurement and a quantitative probability that the third orientation measurement will be within the region.

21. The method of claim 20 further comprising:

comparing the region to the well plan; and automatically adjusting the build curvature or the turn curvature by adjusting the tool settings.

22. The method of claim 20 wherein the determined quantitative uncertainty is a non-zero first percentage value less than 1, and further comprising:

obtaining a fourth orientation measurement to reduce the quantitative uncertainty with the third orientation measurement, wherein the fourth orientation measurement is located between the second position and the third position, and wherein the reduced quantitative uncertainty is a second percentage value greater than the first percentage value and less than 1.

23. The method of claim 19 wherein the determined quantitative uncertainty is greater than 0 and less than 1.

24. The method of claim 1 wherein the drilling settings include a tool face and a build curvature and the method further comprises:

determining an uncertainty that the second orientation will be within a second predetermined region that includes all of the first predetermined region, wherein the determined uncertainty is greater than 0 and less than 1;

comparing the predicted second orientation to a well plan;

determining whether the uncertainty associated with the predicted second orientation is acceptable; and performing an action based on the uncertainty and the comparison of the predicted second orientation to the well plan;

wherein the second orientation is at a position that the measurement device is projected to reach, that is beyond a drill bit connected to the drill string, and that is determined by obtaining a length of the drill string between the first and second orientations;

wherein the measurement related to the first position includes inclination and azimuth;

wherein the first predetermined area has an elliptical shape;

wherein obtaining the measurement related to the first position includes performing a static survey of the wellbore position or orientation; and wherein the action is selected from the group consisting of: ceasing to drill the wellbore and performing a static survey of a wellbore orientation; modifying the tool face; modifying the build curvature; and skipping a planned static survey.

* * * * *